US005878305A

United States Patent [19]

Suzumura et al.

[11] Patent Number: 5,878,305

[45] Date of Patent: Mar. 2, 1999

[54] ELECTROPHOTOGRAPHIC PRINTER

[75] Inventors: Hiroshi Suzumura; Yasuharu Suda; Hiroaki Kuno, all of Hiroshima; Hiroyoshi Kawamura, Mihara, all of Japan

[73] Assignee: Mitsubishi Heavy Industries, Ltd., Tokyo, Japan

[21] Appl. No.: 787,297

[22] Filed: Jan. 24, 1997

[30] Foreign Application Priority Data

Jan. 26, 1996 [JP] Japan ..... 8-011710

[51] Int. Cl.[6] ..... G03G 21/20

[52] U.S. Cl. ..... 399/97; 399/237; 399/250

[58] Field of Search ..... 399/91, 92, 93, 399/94, 97, 38, 44, 237, 250; 165/5; 34/414, 446; 55/210, 217, 338

[56] References Cited

U.S. PATENT DOCUMENTS

| | | | |
|---|---|---|---|
| 3,854,224 | 12/1974 | Yamaji et al. | 399/251 X |
| 3,890,721 | 6/1975 | Katayama et al. | 399/250 |
| 4,662,899 | 5/1987 | Tandon | 55/213 |
| 4,687,319 | 8/1987 | Mishra | 399/250 |
| 4,760,423 | 7/1988 | Holtje et al. | 399/250 |
| 5,481,339 | 1/1996 | De Cock et al. | 399/93 |

FOREIGN PATENT DOCUMENTS

| | | |
|---|---|---|
| 0254498 | 1/1988 | European Pat. Off. . |
| 8-166721 | 6/1996 | Japan . |

*Primary Examiner*—Arthur T. Grimley
*Assistant Examiner*—Hoan Tran
*Attorney, Agent, or Firm*—Wenderoth, Lind & Ponack, L.L.P.

[57] ABSTRACT

To provide an electrophotographic printer which can satisfy regulations for exhaust gas emission easily, a printer is provided with a circulation line for taking out and returning gas generated in a casing of the printer, and a heat exchanger, for cooling the gas and for recovering solvent, is provided midway on the circulation line. The heat exchanger lowers a concentration of the gas. A detection sensor detects a temperature and humidity of the gas in the casing and a heater, provided downstream of the heat exchanger, adjusts a humidity of the gas which is then returned into the casing, upon receiving an output of the detection sensor.

11 Claims, 5 Drawing Sheets

ELECTROPHOTOGRAPHIC PRINTER

BACKGROUND OF THE INVENTION

1. Field of the Invention

The present invention relates to an electrophotographic printer which takes account of exhaust gas regulations.

2. Description of the Prior Art

A conventional electrophotographic printer is described with reference to FIGS. 4 and 5. In FIG. 4, paper which is fed from a paper feed roller 1 passes through a drive roller 2, a paper transfer roller 3 and image carriers 4*a* to 4*d*. Four rollers of said image carriers are disposed in the order of color of blue 4*a*, red 4*b*, yellow 4*c* and black 4*d*, respectively. A printed paper then passes through a paper transfer roller 6, is heated for fixing by a fixing roller 7 and enters a paper delivery portion 9. During this operation, a large amount of solvent gas comes out of the fixing roller 7, hence it is discharged by a blower 15 through an exhaust gas port 8. Numerals 10*a* to 10*d* designate liquid developer tanks for blue, red, yellow and black colors, respectively, and numeral 11 designates a casing.

Next, a printing portion is described by use of FIG. 5. As a prior art, there are disclosed various kinds of method and apparatus for obtaining images by use of an electrophotographic method using a liquid toner, and most widely known is that shown in FIG. 5 in which an electrostatic latent image 29 formed on a surface of an image carrier 4 (4*a* to 4*d*) is applied by a liquid developer 24 by use of a developing device 23 so as to form a toner image 25, a surplus liquid of the toner image 25 is removed by a squeezing device 26, then a transfer charging of a reverse polarity with the toner is made by a transfer device 28 from a back side of a transfer material 27 so that a transfer is made. Incidentally, numeral 40 designates a light exposing device, numeral 41 designates an electrostatic charger, numeral 42 designates a static eliminator and numeral 43 designates a cleaning blade.

Solvent which is generally used in said conventional apparatus is an isoparaffin solvent of a carbon number of 10 or more, which is for example Isopar L.M. etc. of Exxon Chemical Company. While at present in Japan there is no specific regulation as to an exhaust gas containing these solvents, there are regulations in the United Kingdom to limit VOC (volatile organic compound) regarding a printing machine to 150 mg/m$^3$, which is extremely strict. This must be taken account of for a case not only of an international trade but also of future possible regulations in Japan.

As a solvent treatment method, there are ones including an atmospheric emission, a catalytic combustion, an active carbon adsorption and a condensation by cooling. Said respective solvent treatment method, however, has following problems:

① In case of an atmospheric emission, when an amount of use of Isopar L, for example, in a printing machine is 8.64 kg/hr, as the explosion lower limit of concentration of Isopar L is 0.6 to 0.7 volume % (44.732–52.185 mg/m$^3$N), it is so obligated that handling thereof is normally to be made with a concentration of ⅓ or less of said limit. So, if an objective concentration is set to 0.22 volume % (16.402 mg/m$^3$N), a blower capacity becomes 527 m$^3$/hr due to requirement for increasing air volume to be mixed. In this case, the concentration of Isopar L in the gas to be emitted is 16.402 mg/m$^3$N, which may by no means satisfy said regulation in Europe.

In order to dilute said Isopar L of 8.64 kg/hr to 150 mg/m$^3$ by use of air only in the case of atmospheric emission, there is a need to use a blower of a capacity of 57.600 m$^3$/hr, which, being too large, is inappropriate for use in an office room etc.

② In the method of catalytic combustion, hydrocarbon is converted into carbon dioxide and water at a temperature of about 400° C., hence recovery of solvent becomes impossible. Further, as a high temperature combustion gas is discharged as an exhaust gas, the apparatus cannot be installed in an office room.

③ In the method of active carbon adsorption, while hydrocarbon is well adsorbed by active carbon, solvent used in an electrophotographic printer of a carbon number of 10 or more, if it is once adsorbed, cannot be desorbed by use of a hot air but requires a high temperature steam. In a usual office room, there is not such a large steam source, and if a small boiler is used, there is a disadvantage that a treatment device becomes large.

④ In the case of concentration by cooling, as the temperature of gas containing a solvent is lowered, the solvent gas concentration in the gas is also lowered, but in order to attain a concentration of 150 mg/m$^3$ or less, there is a problem as follows: that is, in order to make the concentration of Isopar L to a level of 150 mg/m$^3$ with an aim to satisfy 150 mg/m$^3$ as an outlet concentration of the exhaust gas; it is necessary to make cooling to a temperature of −7.2° C. in relation to vapor pressure. However, there is a problem for maintaining a continuously flowing gas in a range of temperature under 0° C. There occurring a sticking of frost to a cooling portion, it is difficult to maintain the gas at a temperature of −7.2° C. continuously.

SUMMARY OF THE INVENTION

In order to solve the above-mentioned problems in the prior art, the present invention provides following means:

(1) An electrophotographic printer comprising an image carrier, a means for electrostatically charging a surface of said image carrier, a light exposing means for irradiating light to the surface of said image carrier to form a latent image, a developing means for supplying a liquid developer onto said latent image to form a toner image, a means for transferring said toner image onto a surface of a transfer material and a means for fixing an image so transferred on the surface of the transfer material, all contained in a casing, comprises further a circulation means for taking out and returning gas generated in said casing, a gas cooling and solvent recovery means provided midway on said circulation means for lowering a concentration of said gas, a detection means for detecting a temperature and humidity of gas in said casing and a gas heating means provided downstream of said gas cooling and solvent recovery means for adjusting a humidity of gas to be returned into said casing upon receiving an output of said detection means.

By use of the construction as mentioned above, gas in the casing containing solvent is taken out to be cooled by the gas cooling and solvent recovery means, by which a portion of the gaseous solvent is condensed and recovered outside and the gas so cooled is returned into the casing with its concentration having been lowered to a predetermined level.

Further, a temperature and humidity of gas in the casing is detected by the detection means and a signal thereof is sent to the gas heating means. Upon receiving said signal, the gas heating means heats the cooled gas to be returned into the casing so that the gas may maintain a predetermined humidity, for example, 60% or less.

As mentioned above, the gas generated in the casing is recovered of solvent and returned again with a lowered concentration. And at the time of returning, it is heated so as to maintain a predetermined humidity. Further, the gas is circulated with little leakage, hence the strict concentration regulations of foreign countries may be satisfied easily, and the humidity being able to be maintained to a predetermined lower level, the printing can be maintained in a good state.

(2) In the electrophotographic printer mentioned in (1) above, said gas cooling and solvent recovery means is a plate type heat exchanger.

By use of this construction, a cooling medium flows between plates and gas flows in the direction to cross the gas flow between plates, and heat exchange is made via the plates. Solvent thus condensed flows down on the surface of plates and is recovered easily. As so described, according to the present invention, the apparatus can be made with a simple construction and in a compact size and can be operated with a high thermal efficiency, and yet solvent recovery can be done easily.

Figure 1:
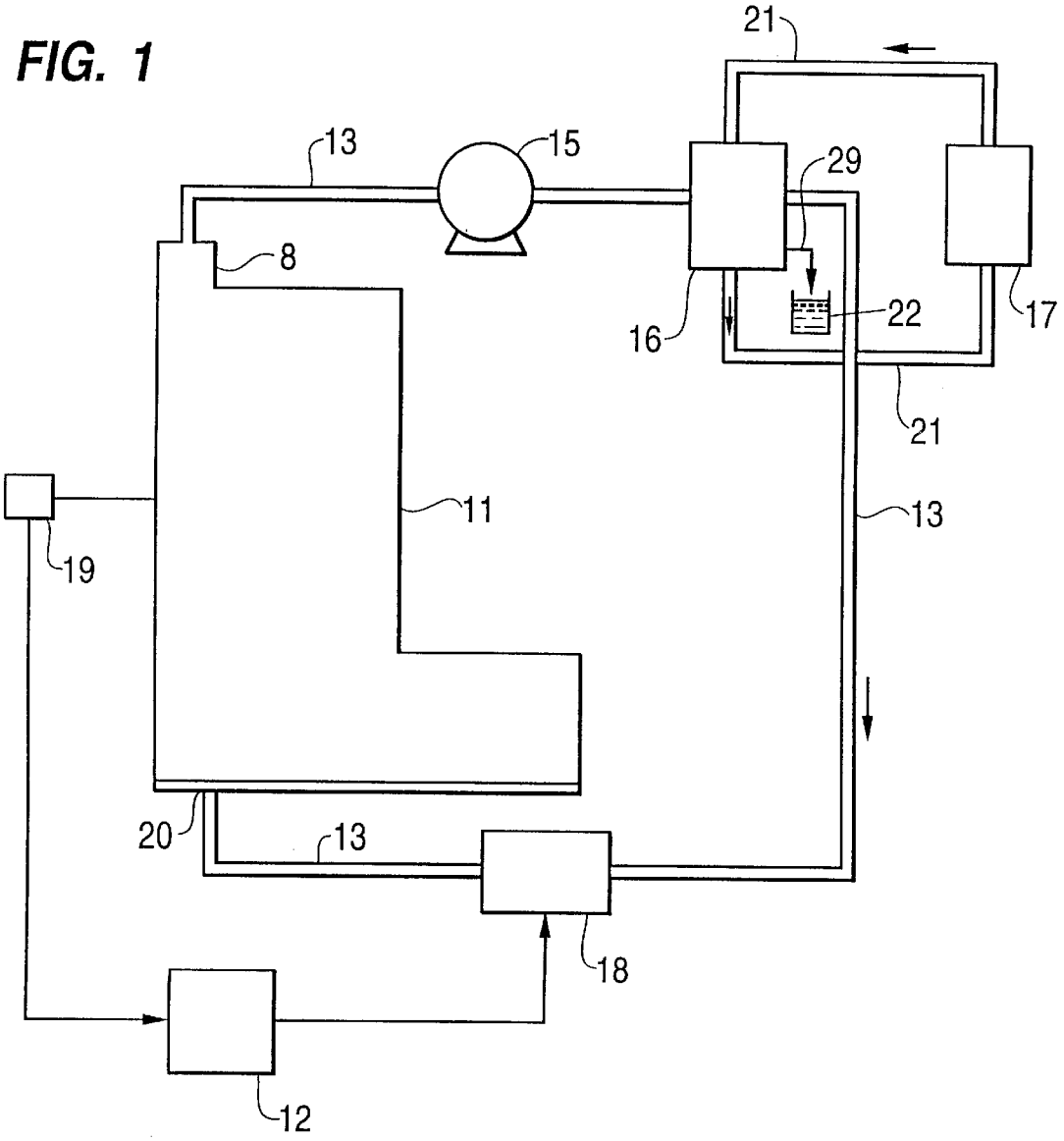
FIG. 1 is a diagrammatic view of an entire construction of one preferred embodiment according to the present invention.

DESCRIPTION OF THE PREFERRED EMBODIMENTS:

One preferred embodiment according to the present invention is described with reference to FIGS. 1 and 2. Those portions as already described with respect to the conventional apparatus are denoted with same reference numerals with description therefor being omitted, and the portions relating to the present invention are described mainly.

In FIG. 1, an exhaust gas port 8 of a casing 11 of an electrophotographic printer is connected to a return port 20 by a circulation line 13 via a blower 15, a heat exchanger 16 and a heater 18. The heat exchanger 16 is provided with a cooling medium circulation line 21 via a cooling medium cooling device 17. A solvent recovery line 29 of the heat exchanger 16 is connected to a solvent recovery tank 22.

An output of a sensor 19 for detecting a temperature and humidity of gas in the casing 11 of the electrophotographic printer is sent to the heater 18 through a humidity adjusting device 12.

Figure 2:
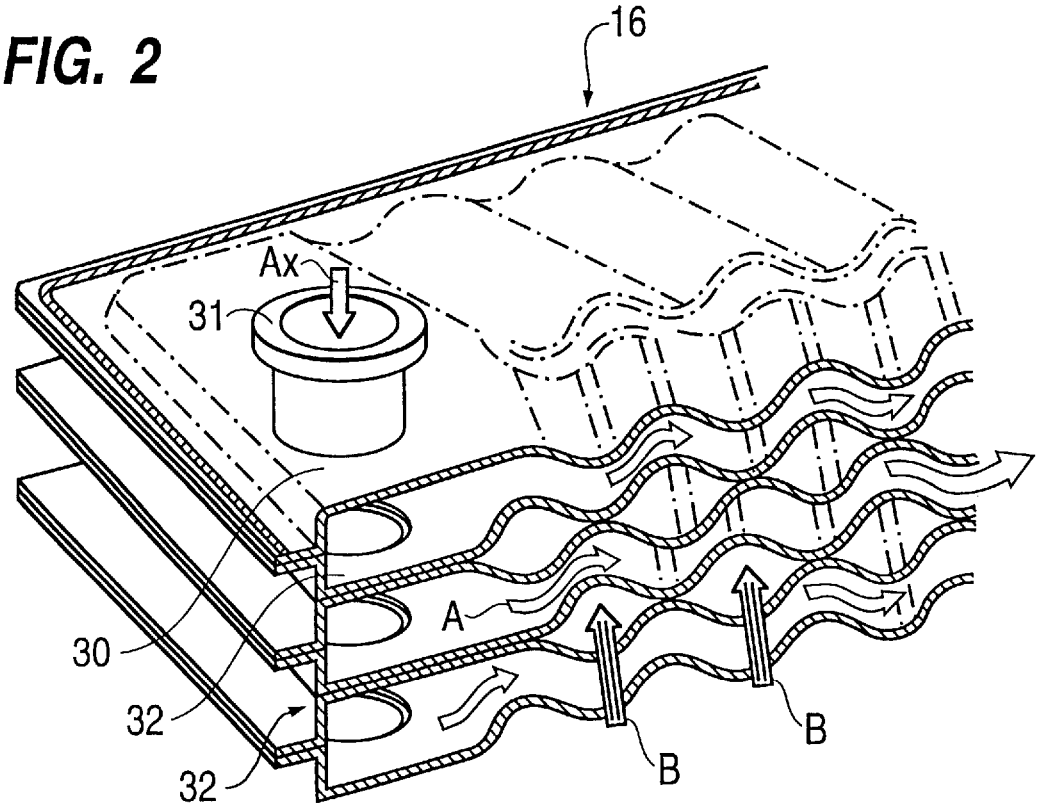
FIG. 2 is a detailed perspective view of a heat exchanger portion of said preferred embodiment.

The heat exchanger 16 is shown in FIG. 2 with details to some extent, which is a known plate type heat exchanger in which wave-shaped plates 30, 32 are assembled. In FIG. 2, numeral A designates a passage of cooling medium and numeral B designates a passage of exhaust gas.

By use of this construction, gas containing a solvent, Isopar L, discharged from the exhaust gas port 8 of the casing 11 is cooled through the heat exchanger 16. Upon a signal of the temperature and humidity sensor 19, the humidity adjusting device 12 sends a control signal to the heater 18 so that the humidity of the returning gas is adjusted to a predetermined value or less. The gas is heated by the heater 18 to a predetermined temperature and is returned to the electrophotographic printer. When the surrounding air is of a high humidity, it is preferable that the heating is so made as to make the gas temperature slightly higher, provided, if the temperature is to be elevated by 2° to 3° C., same may be done by changing the flow rate of the cooling medium slightly with the size of the heat exchanger being kept unchanged.

As the temperature of exhaust gas containing a solvent is lowered, the saturation vapor pressure of the solvent lowers naturally, and a portion of the solvent is condensed and the solvent concentration in the exhaust gas lowers. Examples using a solvent, Isopar L (made by Exxon Chemical Company), are shown below:

TABLE 1

| Cooling temperature (°C.) | Solvent concentration ($mg/^3$) |
|---|---|
| 25 | 3251 |
| 15 | 1406 |
| 5 | 566 |
| −7.2 | 150 |

The cooling medium entering the heat exchanger 16 for cooling the gas containing a solvent comes out of the heat exchanger 16 with an elevated temperature. This temperature elevated cooling medium is cooled by the cooling device (chiller) 17 to the original temperature. Further, the solvent condensed at the heat exchanger (mixture of Isopar L and water) is stored in the solvent recovery tank 22.

Figure 3:
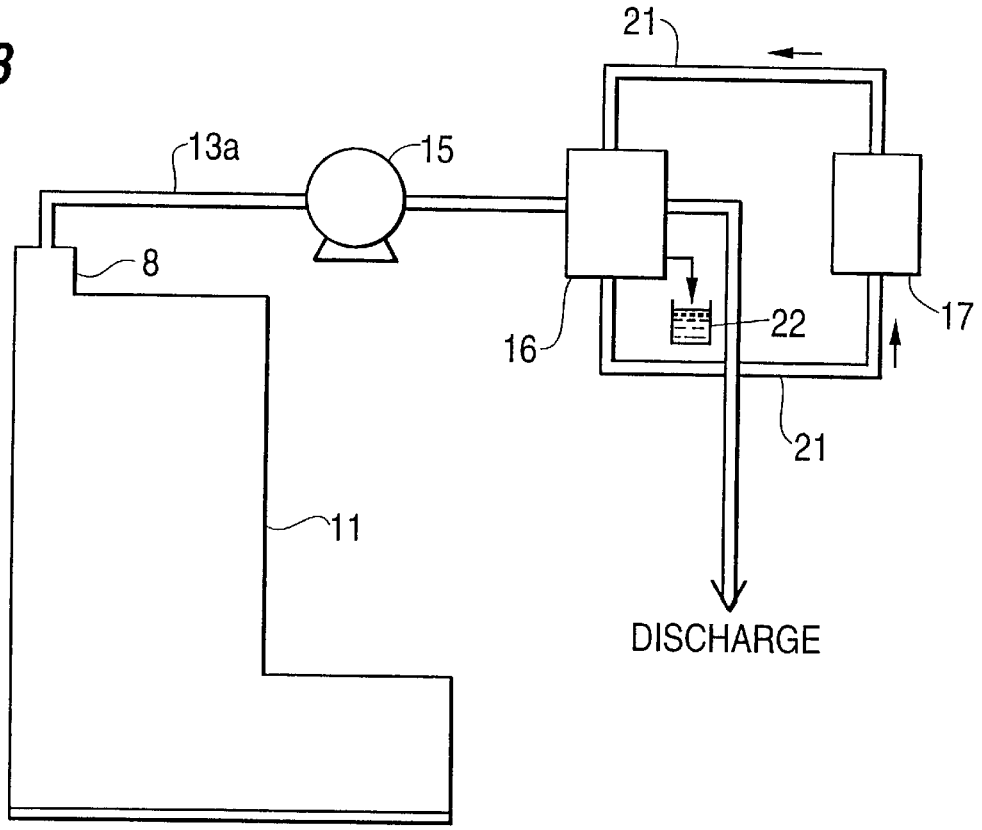
FIG. 3 is a view showing one example of experiments made with respect to said preferred embodiment.
Figure 4:
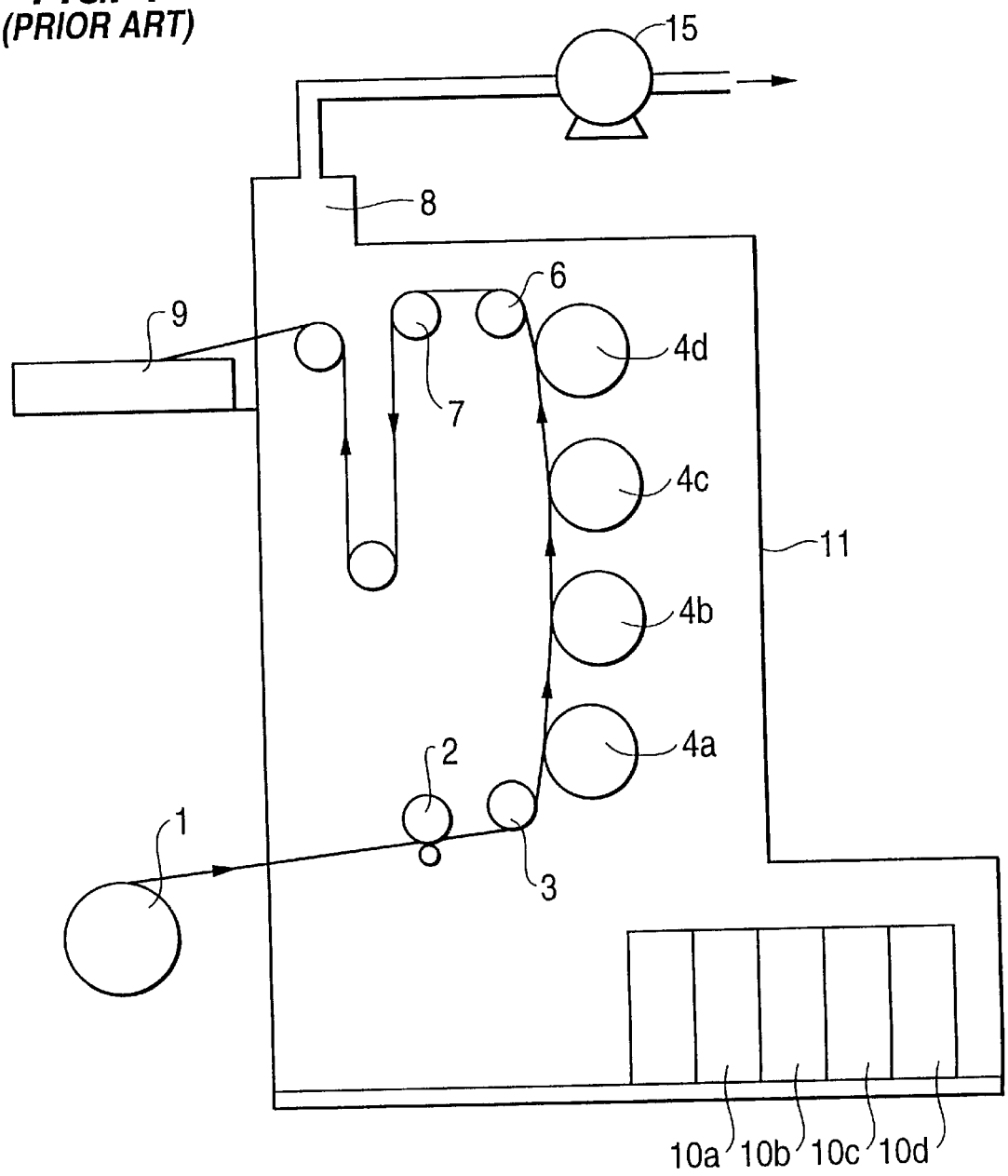
FIG. 4 (PRIOR ART)
FIG. 4 is a diagrammatic view of an entire construction of one example of a conventional electrophotographic printer.
Figure 5:
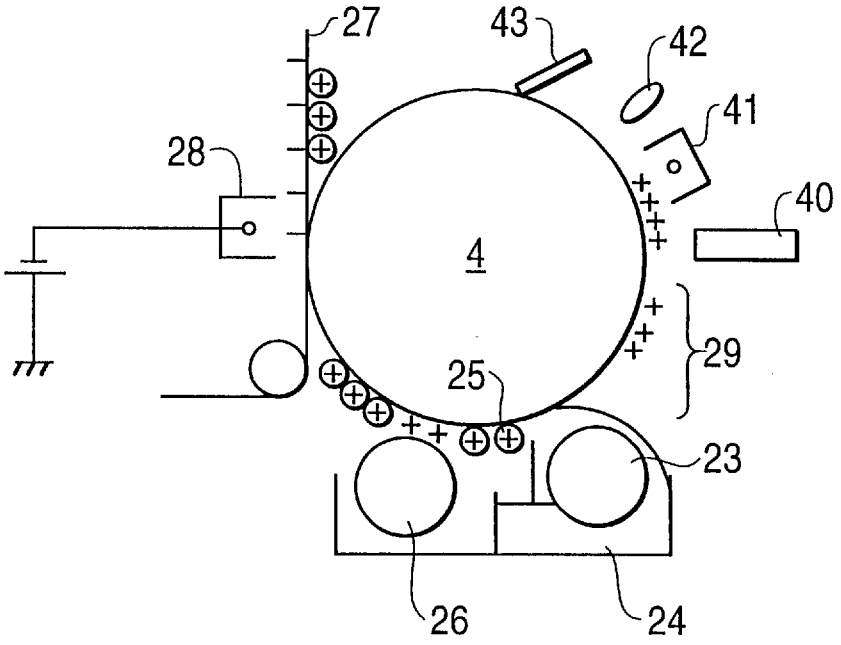
FIG. 5 (PRIOR ART)
FIG. 5 is a schematic view of a printing portion of said conventional electrophotographic printer.

Herebelow described are several examples of experiments:

① In a treatment of Isopar L of 8.64 kg/hr, the exhaust gas temperature at the exhaust gas port 8 was 38° C. and the exhaust gas, after cooled at the heat exchanger, was discharged without being circulated (See FIG. 3). In this system of one path, a heat exchanger of 0.73 m width× 0.51 m height×1.29 m length was required in order to make the gas temperature at the outlet of the heat exchanger 16 to 15° C. The reason for cooling is to recover Ispar L and the amount of the recovered solvent was 8.6 kg/hr. In this case, there is no need to fix the gas temperature to 15° C., but in order to make the heat exchange area of the heat exchanger smaller, a temperature of 10° to 15° C. will be appropriate.

② In case of this preferred embodiment in which said cooled exhaust gas is circulated, the blower capacity was set to 527 $m^3$/hr for reason of the explosion limit of the exhaust gas, then Isopar L contained in the cooled exhaust gas of a temperature of 15° C. was 1,406 $mg/m^3$ (0.8 kg/hr) and the total Isopar L, after added with that generated at a fixing roller, was 9.44 kg/hr, and the temperature of the exhaust gas measured at the exhaust gas port 8 during the circulation operation was 23° C. The size of the heat exchanger 16 used for said circulation operation was 0.73 m width×0.51 m height×0.6 m length. In the case of circulation operation, gas concentration around the printing portion of the electrophotographic printer was measured, which was 150 $mg/m^3$ (20 ppm) in every case. The amount of the recovered solvent was 8.60 kg/hr.

Next, humidity of gas in the electrophotographic printer is described. Saturation steam pressure of air at 15° C. is 12.8 mmHg. As the temperature in the electrophotographic printer becomes 23° C., the relative humidity ψ there=12.8/21.1=0.60=60%, the saturation steam pressure at 23° C. being 21.1 mmHg. Accordingly, there is no need to heat the cooled air, but according to the temperature and humidity of the atmospheric air, there may be a case where ψ becomes slightly higher, hence the cooled air is heated by a heater by 2° to 3° C. so as to maintain a humidity of 60% corresponding to the detected value of the sensor provided at the electrophotographic printer.

The physical property of Isopar L is as follows:

TABLE 2

| | $C_{11}$ | $C_{12}$ | $C_{13}$ | Total |
|---|---|---|---|---|
| Isoparaffin | 5 | 75 | 15 | 95 |
| Naphthalene | | 3 | 2 | 5 |
| Molecular weight | | 167 | | |

As to the method for controlling operation, there are one by way of lowering to the extent possible the temperature of gas in the casing of the electrophotographic printer and one by way of elevating the temperature there slightly (by 2° to 3° C.) in order to make the relative humidity higher, only in the case of a high humidity in the electrophotographic printer. The present preferred embodiment employs the method of the latter. There is no specific correlation for adjusting the temperature between the temperature adjusting heater and the heat exchanger. Actually, there is little case where the temperature adjusting heater is used, which is provided for an extraordinary case or for an emergency case.

As the result of the above, following function and effect can be obtained:

(1) By use of the recovery method by way of condensation by cooling, solvent can be recovered continuously.

(2) By returning the cooled gas to the electrophotographic printer, the heat exchanger can be made smaller as compared with the case of one path system.

(3) By making circulation of the cooled gas, there is substantially no leakage of gas containing a solvent to the outside, so that the recent regulations in Europe regarding a printing machine to limit a VOC emission to 150 mg/$m^3$ can be satisfied.

(4) By heating the cooled gas to elevate the temperature slightly corresponding to the humidity in the electrophotographic printer, the humidity can be maintained to 60% or less and a good printing performance can be maintained.

Thus, according to the electrophotographic printer of the present invention, as the gas is circulated without a substantial leakage, the strict concentration regulations in foreign countries can be satisfied easily. And the humidity being able to be maintained to a predetermined level or less, a good printing status can be maintained. Further, the solvent can be recovered for reuse, and a compact sizing of the heat exchanger becomes possible.

The foregoing invention has been described in terms of a preferred embodiment. However, those skilled in the art will recognize that many variations of such embodiment exist. Such variations are intended to be within the scope of the present invention and the appended claims.

What is claimed is:

1. An electrophotographic printer comprising:

a printer casing;

a printer system, in said printer casing, including a liquid developer supply wherein said printer system produces gas;

a detector connected to the casing of the printer operable for detecting, and providing an output indicative of, a temperature and humidity of gas in said printer casino; and a gas circulation system including an inlet connected to said printer casing, an outlet connected to said printer casing, a gas cooling and solvent recovery system provided downstream of said inlet, and a heater provided downstream of said gas cooling and solvent recovery system operable for heating gas in said gas circulation system based on the output of said detector.

2. An electrophotographic printer as claimed in claim 1, wherein said gas cooling and solvent recovery system comprises:

a heat exchanger;

a cooling medium cooling device;

a cooling medium circulation line connecting said heat exchanger and said cooling medium cooling device; and a solvent recovery device connected to said heat exchanger.

3. An electrophotographic printer as claimed in claim 2, wherein said solvent recovery device comprises:

a solvent recovery tank; and a solvent recovery line connected to said solvent recovery tank and to said heat exchanger.

4. An electrophotographic printer as claimed in claim 1, further comprising:

a blower provided downstream of said inlet and upstream of said gas cooling and solvent recovery system.

5. An electrophotographic printer as claimed in claim 1, further comprising:

a humidity adjusting device connected to said detector and connected to said heater.

6. An electrophotographic printer which uses a liquid developer and a transfer material and which produces a gas containing a solvent, said printer comprising:

a casing;

a printing system in said casing which produces the gas;

a circulation system, for taking the gas from said casing and for returning the gas to said casing;

a gas cooling and solvent recovery system, provided in said circulation system, for lowering a concentration of the solvent in the gas;

a gas temperature and humidity detector in said casing for detecting, and providing an output indicative of, a temperature and humidity of the gas in said casing;

a heater, provided in said circulation system downstream of said gas cooling and solvent recovery device for adjusting the humidity of the gas, based on the output of said detector, before the gas is returned into said casing.

7. An electrophotographic printer as claimed in claim 6, wherein said gas cooling and solvent recovery system comprises:

a cooling medium;

a heat exchanger for exchanging heat from the gas to said cooling medium and condensing the solvent in the gas; and a cooling medium cooling device for cooling said cooling medium.

8. An electrophotographic printer as claimed in claim 7, wherein said gas cooling and solvent recovery system further comprises:

a solvent recovery device connected to said heat exchanger capable of recovering the solvent condensed by said heat exchanger.

9. An electrophotographic printer as claimed in claim 8, wherein said heat exchanger comprises a plate-type heat exchanger.

10. An electrophotographic printer as claimed in claim 6, further comprising:

a humidity adjusting device for receiving the output of said detector and for sending a control signal to said heater to adjust the temperature and humidity of the gas to respective predetermined values.

11. An electrophotographic printer as claimed in claim 6, wherein said printing system comprises:

an image carrier, provided in said casing, said image carrier having a surface;

a charging device, provided in said casing, for electrostatically charging said surface of said image carrier;

a light exposing device, provided in said casing, for irradiating light onto said surface of said image carrier to form a latent image;

a developing device, provided in said casing, for supplying the liquid developer onto the latent image to form a toner image;

a transfer device, provided in said casing, for transferring the toner image onto the transfer material;

a fixing device, provided in said casing, for fixing, on the transfer material, the image transferred by said transfer device.

* * * * *